US005264045A

United States Patent [19]

Zofchak

[11] Patent Number: 5,264,045

[45] Date of Patent: Nov. 23, 1993

[54] METHOD FOR CLEANING MECHANICAL SURFACES COVERED WITH GREASE, OIL AND OTHER STICKY MATERIALS

[76] Inventor: Alfred Zofchak, 6 Gulfstream Blvd., Matawan, N.J. 07747

[21] Appl. No.: 893,811

[22] Filed: Jun. 4, 1992

[51] Int. Cl.[5] ..... B08B 7/00; C23G 5/00

[52] U.S. Cl. ..... 134/40

[58] Field of Search ..... 134/40

[56] References Cited

U.S. PATENT DOCUMENTS

| | | | |
|---|---|---|---|
| 4,180,472 | 12/1979 | Mitchell | 252/162 |
| 4,295,845 | 10/1981 | Sepulveda | 252/162 |
| 4,504,406 | 3/1985 | Dhillon | 134/3 |
| 4,508,633 | 4/1985 | Strempel et al. | 252/135 |
| 4,518,519 | 5/1985 | Lott et al. | 134/40 |
| 4,673,526 | 6/1987 | Zabotto | 252/174.16 |
| 4,707,293 | 11/1987 | Ferro | 252/174.17 |
| 4,806,262 | 2/1989 | Snyder | 252/90 |
| 4,877,556 | 10/1990 | Wilsberg | 252/544 |
| 4,986,927 | 1/1991 | Elton | 252/118 |
| 4,997,588 | 3/1991 | Gillich | 252/139 |
| 5,015,471 | 5/1991 | Birtwistle | 424/70 |
| 5,089,269 | 2/1992 | Noda | 424/456 |
| 5,104,567 | 4/1992 | Staehr | 252/174.17 |
| 5,146,938 | 9/1992 | Lutener et al. | 134/40 |

FOREIGN PATENT DOCUMENTS

| | | | |
|---|---|---|---|
| 2901927 | 7/1979 | Fed. Rep. of Germany | 134/40 |
| 90/3419 | 4/1990 | World Int. Prop. O. . | |

*Primary Examiner*—Theodore Morris
*Assistant Examiner*—Zeinab El-Arini
*Attorney, Agent, or Firm*—Anthony D. Cipollone

[57] ABSTRACT

This invention deals with a new method of using a degreasing composition to remove grease, oil and sticky substances coating a mechanical surface. The degreasing composition sprayed on the coating surfaces will adhere to the coating substances and be washed off with plain water sprayed from a hose, cleaning the mechanical surface effectively and efficiently.

1 Claim, No Drawings

METHOD FOR CLEANING MECHANICAL SURFACES COVERED WITH GREASE, OIL AND OTHER STICKY MATERIALS

BACKGROUND OF THE INVENTION

1. Field of the Invention

This invention relates to the use of a degreasing composition on the surface of a mechanical object coated with grease, oil and other sticky substances. The use of this composition allows the surface to be cleaned effectively and efficiently.

The instant invention provides a method of cleaning greasy, oily and sticky materials from any mechanical surface such as motors, etc. When the degreasing composition of this invention is sprayed onto a motor or other mechanical object, and permitted to set for twenty (20) minutes, it is then possible to spray the coated mechanical surface with plain water from a hose and clean the surface effectively and efficiently.

In addition, the degreasing composition is biodegradable.

The preferred embodiment of the instant invention is as follows:

| MATERIALS | % |
|---|---|
| Methyl Coconate | 94.0 |
| Tween 80 | 4.0 |
| (20 mole ethoxylate sorbitan monooleate) | |
| Tween 20 | 2.0 |
| (20 mole ethoxylate sorbitan monolaurate) | |

Coconut Acid is a mixture of fatty acids varying in length from six (6) to eighteen (18) carbon atoms. It reacts with methyl alcohol to produce methyl coconate as follows:

$$R_1COOH + HOR_2{-}R_1\overset{\overset{\displaystyle O}{\|}}{C}{-}OR_2$$

where $R_1$ varies from $C_5H_1CH_2$

-continued to $C_{17}C_{35}CH_2$; and $R_2 = CH_3$.

2. Description of Prior Art

U.S. Pat. No. 4,238,373, issued Dec. 9, 1980, describes a process for making detergent compositions containing nitrogenous cationic surfactant.

U.S. Pat. No. 4,619,779 issued Oct. 28, 1986, describes a detergent additive product comprising a C5–C18 aliphatic carboxylic acid bleach precursor in water releasable combinations.

OBJECTS AND SUMMARY OF THE INVENTION

It is the object of this instant invention to introduce a method of cleaning mechanical surfaces coated with grease, oil and other sticky substances by the use of a degreasing composition which may be applied to the coated mechanical surface to be cleaned and be allowed to set on the coated mechanical surface to be cleaned.

Subsequent spraying with plain water then removes the degreasing composition along with the greasy, oily, sticky coat from the mechanical surface, cleaning the mechanical surface simply, efficiently and effectively.

The preferred embodiment of the degreasing composition of this invention is as follows:

| MATERIALS | % |
|---|---|
| Methyl Coconate | 94.0 |
| Tween 80 | 4.0 |
| Tween 20 | 2.0 |

The materials have been previously described above.

What is claimed is:

1. A method of removing grease, oil from a mechanical surface consisting of 94.0% mono-methyl coconate, 4.0% 20 mole ethoxylate sorbitan monooleate and 2.0% 20 mole ethosylate sorbitan monolaurate, the application of said composition to the said mechanical surface covered with said grease, oil; allowing said composition to remain on said surface for a period of time to set and then spray washing the said composition covering the said mechanical surface covered with grease oil with water causing the said composition, grease oil to be removed from the mechanical surface.

* * * * *